US005596847A

United States Patent [19]

Stephenson

[11] Patent Number: 5,596,847

[45] Date of Patent: Jan. 28, 1997

[54] BAFFLE VENT STRUCTURE

[75] Inventor: Michael R. Stephenson, Springfield, Ill.

[73] Assignee: Inno-Vent Plastics, Inc., Springfield, Ill.

[21] Appl. No.: 323,535

[22] Filed: Oct. 14, 1994

[51] Int. Cl.[6] ..... E04B 7/00

[52] U.S. Cl. ..... 52/198; 52/95

[58] Field of Search ..... 52/95, 198

[56] References Cited

U.S. PATENT DOCUMENTS

| | | | |
|---|---|---|---|
| 1,976,166 | 10/1934 | Friedberg . | |
| 2,122,926 | 7/1938 | Blacher . | |
| 2,154,734 | 4/1939 | Doing . | |
| 3,293,810 | 12/1966 | Cox et al. . | |
| 3,524,289 | 8/1970 | Yozejian | 52/95 |
| 3,683,785 | 8/1972 | Grange . | |
| 4,016,700 | 4/1977 | Blomstedt . | |
| 4,096,790 | 6/1978 | Curran | 52/198 X |
| 4,102,092 | 7/1978 | Ward . | |
| 4,125,971 | 11/1978 | Ward . | |
| 4,214,510 | 7/1980 | Ward . | |
| 4,237,672 | 12/1980 | Peterson . | |
| 4,406,095 | 9/1983 | Slavik | 52/95 |
| 4,446,661 | 5/1984 | Jonsson et al. . | |
| 4,660,463 | 4/1987 | Bottomore et al. . | |
| 4,745,716 | 5/1988 | Kuypers . | |
| 4,916,875 | 4/1990 | Kashiwagi . | |
| 4,995,308 | 2/1991 | Waggoner . | |
| 5,341,612 | 8/1994 | Robbins | 52/95 |

FOREIGN PATENT DOCUMENTS

| | | |
|---|---|---|
| 2145756 | 4/1985 | United Kingdom . |

*Primary Examiner*—Wynn E. Wood
*Assistant Examiner*—W. Glenn Edwards
*Attorney, Agent, or Firm*—Wood, Phillips, VanSanten, Clark & Mortimer

[57] ABSTRACT

A baffle vent is provided for positioning between the underside of a roof and the top edges of the roof rafters and defining a duct between the rafters and between the vent and the interior surface of the roof for directing air over the interior surface of the roof. The vent is formed by an elongated self-supporting structure of sheet-like material having a plurality of longitudinal ribs adapted for positioning onto the top edges of the roof rafters. A plurality of longitudinal troughs are formed between the ribs and define the duct between the rafters. The ribs are on eight inch centers spacing the ribs transversely of the structure. The troughs include bottom walls spaced below the interior surface of the roof with transverse rigidifying means formed integrally with the bottom walls.

9 Claims, 1 Drawing Sheet

FIG. 1
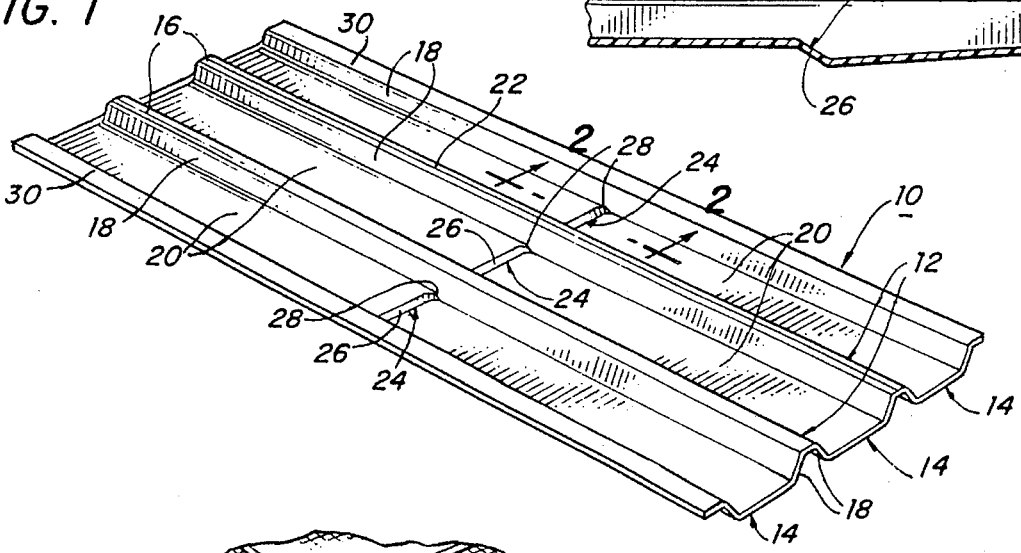
FIG. 2
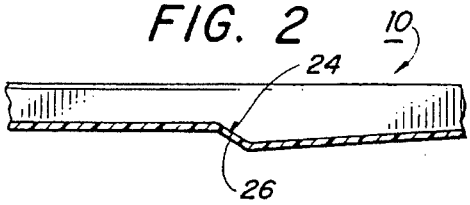
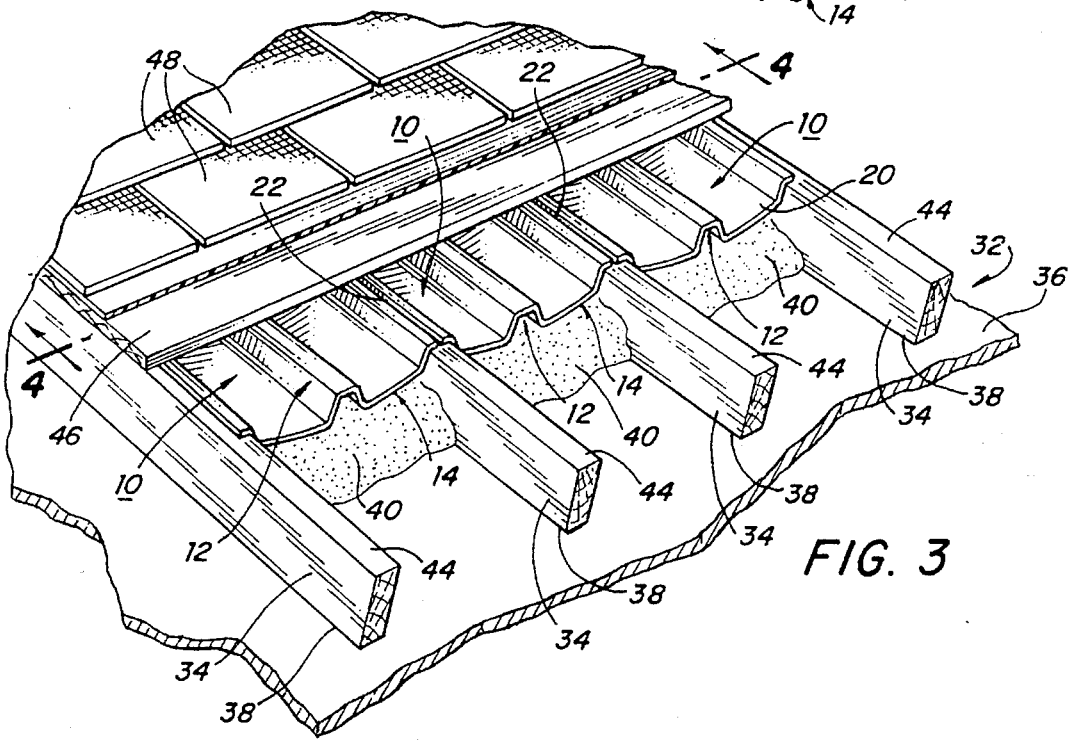
FIG. 3
FIG. 4
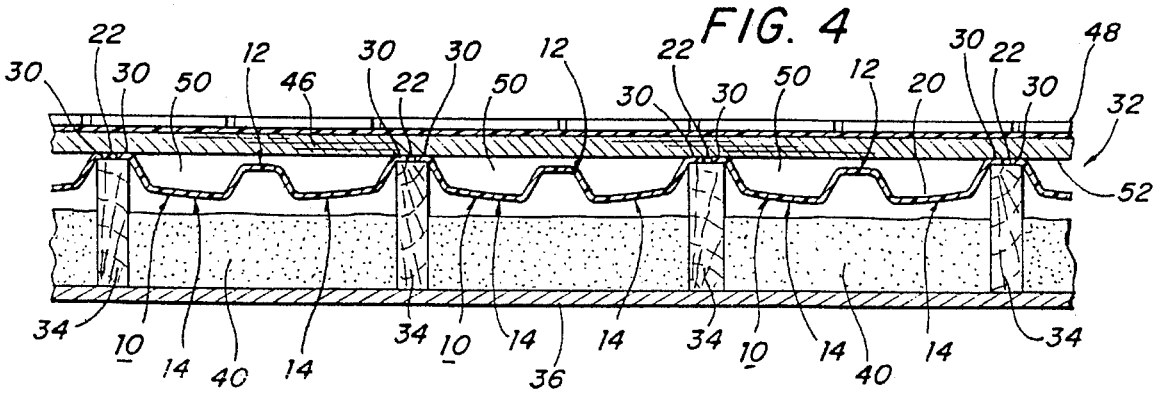

BAFFLE VENT STRUCTURE

FIELD OF THE INVENTION

This invention generally relates to a baffle vent structure for positioning against the underside of a roof to direct air over the interior surface of the roof.

BACKGROUND OF THE INVENTION

It has been known to provide various forms of baffles in roofing structures to direct or channel air along the underside of the roof, usually from the soffit area of the roof upwardly toward vent ducts or a crest or ridge vent. Such baffle vents often are called "vent chutes". The baffle vents provide barriers to separate the interior surface of the roof from the attic area and from such extraneous materials as insulation which might be located near the underside of the roof. The baffles direct the air against the surface of the roof, eliminate the build-up of moisture and prevent ice formations during winter months.

A major consideration in the design and manufacture of such baffle vents has been in the cost of such structures. Taking into consideration the large square footage of the roofs of buildings, such as residential homes, it has been a goal to design baffle vents so that they do not add appreciably to the cost of construction. Consequently, heretofore, baffle vents have been fabricated extensively of foam material in sheets and formed to be self-supporting so that the vents can be handled and manipulated into position for attachment against the interior surface of a roof.

Heretofore, such baffle vents conventionally have been narrow elongated structures so that they fit between the rafters of a roof structure. When the use of foam materials was initiated in fabricating such baffle vents, the structures originally were relatively thick and of a simple channel configuration in cross-section so as to be self-supporting. Such thick structures were relatively expensive and added appreciably to the cost of construction. U.S. Pat. No. 5,341,612 to Robbins, dated Aug. 30, 1994, discloses a baffle vent structure of a thinner foam sheet material and includes an improved reinforced structure to prevent the vents from collapsing during shipping, handling and installation, as well as to prevent collapsing of the vents from compacted insulation which often is blown into attic areas of a building against the underside of the baffle vents.

Baffle vent structures of the character described above, such as the vent shown in the aforesaid patent, all are designed for positioning between the rafters of a roof. The vents have attaching flanges running along the length of the baffle vent at the side edges thereof for attaching the vents to the underside or interior surface of the roof between the rafters. Consequently, accommodations had to be made for rafters of different spacing. In addition, unfortunately, such baffle vent structures are not appropriate for use in contemporaneous construction of "manufactured housing".

More particularly, in manufactured housing, the ceiling/roof structure is assembled or manufactured "inside-out". In other words, drywall sheeting first is applied to the bottom edges of the rafters to form the inside ceiling of the housing. Insulation then is installed between the rafters on top of the drywall. The roof sheeting (e.g. plywood panels) then is attached to the top edges of the rafters and, lastly, the exterior roofing (e.g. shingles) are applied to the top of the sheeting. It readily can be understood that baffle vent structures heretofore known, i.e. structures designed for attaching to the interior surface of the roof sheeting, cannot be used when the ceiling/roof structure is manufactured inside-out as described above.

The present invention is directed to improvements in baffle vent structures wherein the vents are designed for installation on top of the roof rafters before attaching the roof sheeting. The improved baffle vent structure provides versatility for roof structures of varying rafter spacing, and the vents are rigidified to afford fabrication with a thin foam sheet material.

SUMMARY OF THE INVENTION

An object, therefore, of the invention is to provide a new and improved baffle vent structure of the character described.

In the exemplary embodiment of the invention, a baffle vent is disclosed for positioning between the underside of a roof and the top edges of the roof rafters. The vent defines a duct means between the rafters and between the vent and the interior surface of the roof for directing air over the interior surface of the roof.

The invention contemplates that the baffle vent be formed by an elongated self-supporting structure of sheet-like material having a plurality of longitudinal ribs for positioning onto the top edges of the roof rafters. A plurality of longitudinal troughs run longitudinally between the ribs and define the duct means between the rafters. The ribs are on eight inch centers spacing the ribs transversely of the structure. The troughs include bottom walls spaced from the interior surface of the roof, with transverse rigidifying means formed integrally with the bottom walls.

As disclosed in the preferred embodiment, the ribs are defined by top walls and side walls. The top walls are adapted for positioning onto the top edges of the rafters. The side walls form side walls of the troughs. The side walls are sized and configured to space the bottom walls of the troughs at least one inch below the interior surface of the roof. The transverse rigidifying means in the bottom walls of the troughs extend into junctures between the bottom walls and the side walls. Lastly, the structure includes generally parallel longitudinal side edges each defined by one-half of one of the ribs in a transverse direction. The structure is fabricated of molded polystyrene foam material.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a top perspective view of a baffle vent structure incorporating the concepts of the invention;

FIG. 2 is a fragmented vertical section, on an enlarged scale, taken generally along line 2—2 of FIG. 1;

FIG. 3 is a fragmented perspective view illustrating the baffle vent structure according to the invention attached between the underside of a roof and the top edges of the roof rafters; and FIG. 4 is a fragmented vertical section, on an enlarged scale, taken generally along line 4—4 of FIG. 3.

DETAILED DESCRIPTION OF THE PREFERRED EMBODIMENT

Referring to the drawings in greater detail, and first to FIG. 1, the invention is embodied in a baffle vent structure, generally designated 10, for positioning between the underside of a roof and the top edges of the roof rafters as will be seen hereinafter in describing FIGS. 3 and 4. Suffice it to say at this point, the baffle vent structure defines a duct means between the rafters and between the vent and the interior surface of the roof for directing air over the interior surface of the roof.

More particularly, baffle vent 10 is formed as an elongated self-supporting structure of sheet-like material, such as molding the structure of polystyrene foam material. The vent has a plurality of longitudinal ribs, generally designated 12, for positioning onto the top edges of the roof rafters, as described hereinafter. The vent includes a plurality of longitudinal troughs, generally designated 14, between ribs 12 defining the duct means between the rafters. Each rib 12 is defined by a top wall 16 and a pair of side walls 18. The top walls are adapted for positioning onto the top of edges of the roof rafters. The side walls, in turn, form side walls of troughs 14 which include bottom walls 20. In other words, side walls 18 form the side walls of ribs 12 as well as the side walls of troughs 14.

The ribs of baffle vent structure 10 are spaced transversely of the structure on eight inch centers. This is to accommodate conventional or specification spacing of roof rafters on sixteen or twenty four etc. inch centers. Therefore, it can be understood that the vent structure 10 shown in FIG. 1 is designed for positioning between roof rafters that are on twenty four inch centers (i.e. three troughs 14 between each adjacent pair of rafters). The right-hand rib includes a score line 22 running the length thereof to facilitate cutting vent structure 10 longitudinally to include only two troughs 14 for installing the vent structure between roof rafters on sixteen inch centers, as will be seen in FIGS. 3 and 4.

Bottom walls 20 of troughs 14 are provided with transverse rigidifying means, generally designated 24, formed integrally with the bottom walls. The rigidifying means of each bottom wall is formed by a molded transverse rib 26 (see FIG. 2). The ribs run transversely into the junctures between bottom walls 20 and side walls 18, as at 28 in FIG. 1, to form sort of a truss means at those locations to further rigidify bottom walls 20. Contemporary specifications require that the bottom walls be spaced at least one inch from the interior surface of the roof to define adequate duct means, and rigidifying means 24 ensure that the troughs are not collapsed, such as when excessive insulation might be installed between the rafters. Baffle vent 10 in FIG. 1 is relatively dimensioned to be four feet long, with rigidifying means 24 being at a mid-point thereof, i.e. two feet from the opposite ends of the structure. If the vent were six or eight feet long, preferably rigidifying means 24 would be spaced longitudinally at two foot increments.

Lastly, opposite side edges 30 of baffle vent structure 10 are defined by one-half of one of the ribs 12 in a transverse direction. Therefore, when a pair of vents are installed side-by-side in a ceiling/roof construction, the juxtaposed side edges of the two vents form a full rib positioned on top of a single roof rafter. Normally, staples would be used to attach the vents to the top edges of the rafters.

FIGS. 3 and 4 show three vents 10 installed side-by-side in a ceiling, roof construction, generally designated 32. The construction includes a plurality of parallel roof rafters 34 such as of 2×4, 2×6, etc. lumber. Drywall panels or sheeting 36 then are installed against the bottom edges 38 of the rafters. Insulation 40 then in installed between the rafters. Baffle vents 10 then are installed on top of the rafters.

More particularly, rafters 34 have been installed on sixteen inch centers as shown in FIGS. 3 and 4. Therefore, baffle vents 10 have been cut along score lines 22 (FIG. 1) to size the vents to sixteen inch widths (i.e. with ribs 12 are on eight inch centers). Therefore, in the illustration of FIGS. 3 and 4, side edges 30 (FIG. 1) are secured (as by stapling) onto top edges 44 of the rafters. However, since each edge 30 forms one-half of a single rib 12, a full rib is provided at each rafter for securing to top edge 44 thereof. Between the rafters, one of the ribs 12 forms longitudinal rigidifying support for the baffle vent structure, and rigidifying means 24 provide transverse support for the structure whereby the vent is a self-supporting structure.

After vents 10 are installed onto the top edges 44 of rafters 34, roof sheeting 46 (e.g. plywood panels) are installed over the vents and secured through the vents to the top edges of the rafters. Lastly, appropriate roofing, such as shingles 48, are installed onto the top of roof panels 46. The resulting structure provides duct means, as at 50 in FIG. 4, between rafters 34 and between vents 10 and the inside surface 52 of the roof.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A single baffle vent for positioning between the underside of a roof and the top edges of roof rafters to define a duct means between the rafters and between the baffle vent and the interior surface of the roof for directing air over the interior surface of the roof, the baffle vent being compatible with both 16 inch and 24 inch center roof rafters, the baffle vent comprising:

an elongated self-supporting structure of sheet-like material having a plurality of longitudinal ribs spaced transversely of the structure on eight inch centers and adapted for positioning onto the top edges of the roof rafters, and a plurality of longitudinal troughs between the ribs defining said duct means between the rafters, and said troughs including bottom walls spaced a predetermined distance below the interior surface of the roof.

2. A ventilated, manufactured ceiling/roof construction comprising:

a plurality of parallel, spaced rafters, each rafter having a top edge and a bottom edge;

a ceiling sheeting panel installed against said bottom edges of the rafters;

insulation installed between the rafters and above said sheeting panel;

a baffle vent installed against the top edges of the rafters and extending between adjacent rafters, above the insulation; and a roof sheeting panel installed over the baffle vent and secured to the rafters to define an interior roof surface, the baffle vent directing air over the interior roof surface.

3. The manufactured ceiling/roof construction of claim 2 further comprising a plurality of the baffle vents installed against the top edges of the rafters, one baffle vent extending between each pair of adjacent rafters, above the insulation, directing air over the interior roof surface.

4. The manufactured ceiling/roof construction of claim 2 wherein the baffle vent has a plurality of longitudinal ribs, one longitudinal rib being positioned on the top edge of each of the adjacent rafters.

5. The manufactured ceiling/roof construction of claim 4 wherein one of the longitudinal ribs is positioned between each of the adjacent rafters.

6. The manufactured ceiling/roof construction of claim 4 wherein the baffle vent further includes a plurality of longitudinal troughs between the ribs to direct air over the interior surface of the roof.

7. The manufactured ceiling/roof construction of claim 6 wherein the ribs are defined by top walls and side walls, the top walls positioned on the top edges of the rafters and the side walls forming side walls of the troughs.

8. The baffle vent of claim 1 wherein:

the plurality of ribs include two adjacent ribs, each of the adjacent ribs having a top wall and two side walls, one of the adjacent rib top walls having a longitudinal extending score line running the length thereof.

9. A single baffle vent for positioning between the underside of a roof and the top edges of roof rafters to define a duct means between the rafters and between the baffle vent and the interior surface of the roof for directing air over the interior surface of the roof, the baffle vent being compatible with both 16 inch and 24 inch center roof rafters, the baffle vent comprising:

an elongated self-supporting structure of sheet-like material having at least four longitudinal ribs spaced transversely of the structure on eight inch centers and adapted for positioning onto the top edges of the roof rafters, a first one of the ribs located at a first lateral edge of the sheet, a second one of the ribs located at a second lateral edge of the sheet, at least one of the other ribs located intermediate the first and second ribs and having a top wall and two side walls, the top wall having a longitudinal extending score line running the length thereof; and a plurality of longitudinal troughs between the ribs defining said duct means between the rafters, the troughs including bottom walls spaced a predetermined distance below the interior surface of the roof.

* * * * *